United States Patent [19]

Dupin

[11] Patent Number: 4,905,751

[45] Date of Patent: Mar. 6, 1990

[54] METHOD FOR CASTING A ROCKER ARM FOR AN INTERNAL COMBUSTION ENGINE AND MOULD STRUCTURE FOR CARRYING OUT THE CASTING METHOD

[75] Inventor: Jean Dupin, Versailles, France

[73] Assignees: Automobiles Peugeot; Automobiles Citroen, both of France

[21] Appl. No.: 178,209

[22] Filed: Apr. 6, 1988

[30] Foreign Application Priority Data

Apr. 14, 1987 [FR] France ..... 87 05300

[51] Int. Cl.[4] ..... B22D 19/00

[52] U.S. Cl. ..... 164/112; 164/47; 164/334

[58] Field of Search ..... 164/97, 98, 112, 332, 164/334

[56] References Cited

FOREIGN PATENT DOCUMENTS 59-13563 4/1984 Japan ..... 164/112

2103534 2/1983 United Kingdom ..... 164/332

*Primary Examiner*—Richard K. Seidel

*Attorney, Agent, or Firm*—Steinberg & Raskin

[57] ABSTRACT

The present invention concerns essentially a method for moulding a rocker arm for an internal combustion engine and the mould structure for carrying out this method, which mould structure comprises a device for maintainiing a ceramic reinforcing element of the arm of the rocker arm co-operating with the cam of a camshaft and comprising a spindle-forming part disposed on the end of the reinforcing element and a pusher-forming assembly located above the spindle-forminig part to forcibly urge the latter against the reinforcing element.

8 Claims, 1 Drawing Sheet

METHOD FOR CASTING A ROCKER ARM FOR AN INTERNAL COMBUSTION ENGINE AND MOULD STRUCTURE FOR CARRYING OUT THE CASTING METHOD

BACKGROUND OF THE INVENTION

The present invention concerns a method for moulding a rocker arm for an internal combustion engine, a mould structure for carrying out such a method as well as a rocker arm obtained according to the moulding method.

The invention concerns also a method for machining the rocker arm obtained from the moulding method as well as a rocker arm obtained according to the machining method.

There are known rocker arms of the type comprising a lever body with a first arm co-operating with a cam of a camshaft of the engine and with a second arm co-operating with a valve spindle, the lever body, made of a light metal alloy, being obtained by a chilled diecasting method. The arm which co-operates with the cam comprises an extremely hard reinforcing element which withstands the wear caused by friction with the cam which is inserted during the moulding inside the rocker arm made of light metal alloy. To this end, the reinforcing element is made of sintered material. carbide or special cast iron.

However, the above materials forming the reinforcing element were not always totally satisfying, making therefore the manufacturers use ceramic reinforcing elements presenting a better wear behavior than the above-mentioned metallic materials, provided that the friction surface of the reinforcing element is close to the "mirror polish". The polish of the friction surface of the reinforcing element is obtained according to a known method before the mounting thereof inside the rocker arm which means that the reinforcing element will not be machined after casting or moulding of the rocker arm. All the machining of the rocker arm will therefore be carried out by starting from the reinforcing element.

However, provided that the ceramic reinforcing element is extremely hard and brittle and non-magnetic, it is necessary to maintain it firmly inside the mould without breaking risk.

Moreover, as the blocks obtained after "mirror polish" machining cannot have absolutely identical dimensions, it is necessary to provide a device which permits to compensate for the dimension differences of the blocks.

SUMMARY OF THE INVENTION

The present invention solves the above problems by proposing a method for moulding a rocker arm for an internal combustion engine characterized in that it consists in maintaining firmly the ceramic reinforcing element, the surface of which in friction relationship with the cam is previously polished, inside the mould at least during the operation of moulding the rocker arm with spindle-foring means which is forcibly urged against the end of the reinforcing element opposite to the friction surface thereof.

According to a feature of the moulding method of the invention, there is performed a part projecting from the arm of the rocker arm co-operating with the cam opposite the reinforcing element and comprising a preferably plane surface perpendicular to the longitudinal axis of the reinforcing element.

The mould structure for carrying out the above-defined method, of the type comprising two boxes, one top box and one bottom box, is characterized in that it comprises a device for maintaining the reinforcing element inside one of the boxes, comprising the aforesaid spindle-forming part disposed on the end of the reinforcing element and a pusher-forming assembly above the spindle-forming part to forcibly urge the latter against the reinforcing element.

According to a feature of the mould structure, the pusher-forming assembly comprises an elongated pusher along the extension of the spindle-forming part, a prestressed return resilient means urged against the elongated pusher and a means for prestressing the resilient means solid with the box.

The aforesaid return resilient means makes it possible to compensate for the dimension differences between two blocks.

The invention proposes also a method for machining the rocker arm obtained by the above moulding method and characterized in that it consists in maintaining the arm of the rocker arm co-operating with a valve spindle with appropriate means and in urging the reinforcing element of the rocker arm against a corresponding bearing surface through a clamping finger-forming means resting on the plane surface of the projecting part of the rocker arm.

BRIEF DESCRIPTION OF THE DRAWINGS

For a fuller understanding of the invention, reference is made to the following description taken in conjunction with the accompanying drawing, in which.

DETAILED DESCRIPTION OF THE PREFERRED EMBODIMENT

Figure 1:
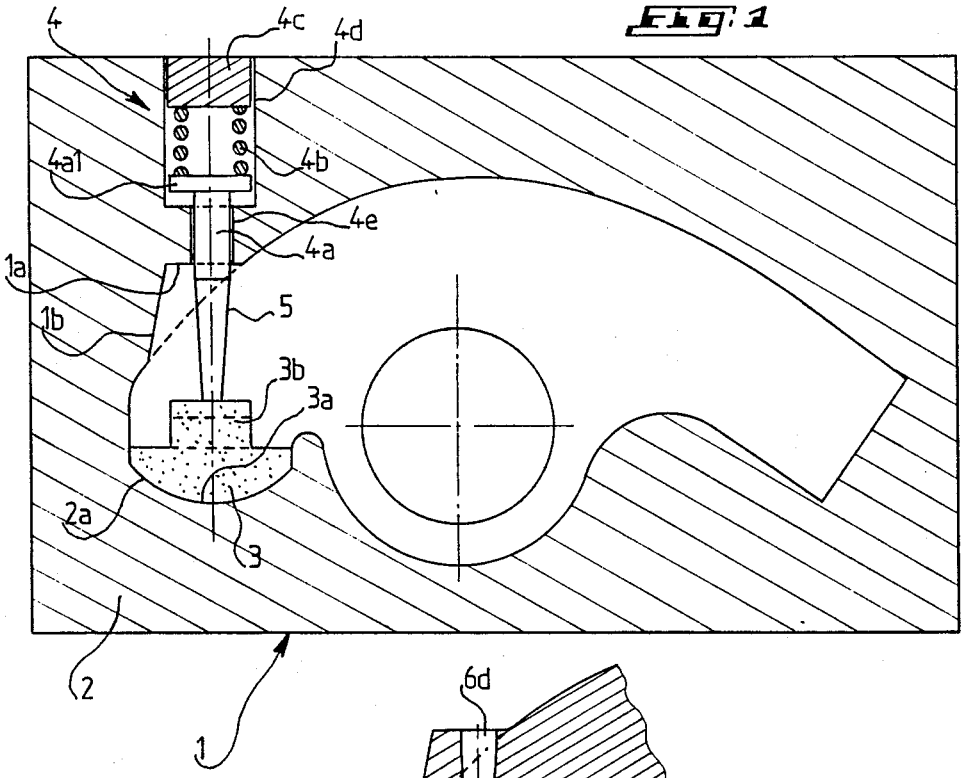
FIG. 1 is a longitudinal cross-sectional view showing in particular the device for maintaining the ceramic reinforcing element inside the mould structure according to the invention.

Referring to FIG. 1, the mould structure 1 for the pressure diecasting of the light metal alloy forming the rocker arm comprises two boxes, one top box and one bottom box, the bottom box 2 only being shown in the Figure.

The numeral 3 designates a ceramic reinforcing element which is to be rendered solid, after moulding, with the arm of the lever body of the rocker arm co-operating with a cam of a camshaft of an internal combustion engine. This reinforcing element comprises a friction surface 3*a* intended to co-operate with the cam and previously polished according to a known method. This friction surface presents a bellied or convex shape which fits into a corresponding recess 2*a* of the bottom box 2. The reinforcing element 3 comprises further an anchoring end-forming part 3*b* of the element at the end of the arm of the rocker arm co-operating with the cam and located opposite the friction surface 3*a*.

According to the invention, a pusher-forming device 4 exerts a thrust on a spindle-forming part 5 so as to forcibly urge the latter against the anchoring end-forming part 3*b* of the reinforcing element 3. The spindle-forming part 5 located along the longitudinal axis of the reinforcing element 3 is preferably circular in cross-section, any other cross-sectional shape (oval, rectangular and so on) being also appropriate.

The pusher-forming device 4 comprises from the bottom to the top with respect to FIG. 1 and along the longitudinal axis of the reinforcing element 3 an elongated pusher 4*a* the lower end of which rests on the upper part of the spindle-forming part 5 and which carries at its upper end a head 4*a*1, a prestressed return resilient means 4*b* resting on the head 4*a*1 of the elongated pusher and means 4*c* for prestressing the resilient means 4*b*, the means 4*c* being movable and retracting as the mould opens. The prestressing means 4*c* may be formed of a screw or any other mechanical means for adjusting the prestress of the resilient means 4*b* which may be formed of a compression spring or of steel resilient washers of the type of Belleville washers. The prestressing means 4*c*, the return resilient means 4b and the head 4*a*1 of the pusher 4*a* are housed inside a bore 4*d* of the bottom box 2 whereas the elongated part of the pusher 4*a* passes through a bore 4*e* with a lower diameter than that of the bore 4*d* and which starts from the bottom of the latter and terminates in the hollow space of the mould, the lower end of the elongated part projecting into the hollow space of the mould.

It is seen that the pusher-forming assembly 4 forcibly urges the spindle-forming part 5 against the reinforcing element 3 which is therefore firmly maintained inside the recess 2*a* of the bottom box 2.

FIG. 1 shows also the presence of a plane wall 1*a* carried out in the hollow space of the bottom box 2 perpendicularly to the longitudinal axis of the reinforcing element 3, the bore 4*e* terminating at this wall. The wall 1*a* is connected to the curved wall defining the upper end of the arm of the rocker arm co-operating with the cam through a plane wall 1*b*.

Figure 2:
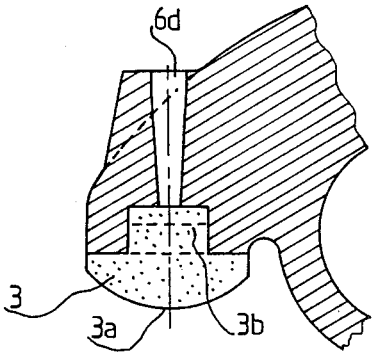
FIG. 2 is a cross-sectional view of the end of the arm of the rocker arm provided with the ceramic reinforcing element.

During the pressure injection of the material made of light metal alloy forming the rocker arm, the anchoring end-forming part 3*b* of the reinforcing element 3 will be embedded with the spindle-forming part 5 inside the material of the rocker arm (see FIG. 2), which spindle-forming part 5 will have sufficient diameter to withstand the impacts resulting from the arrival of the pressure injected material.

Figure 3:
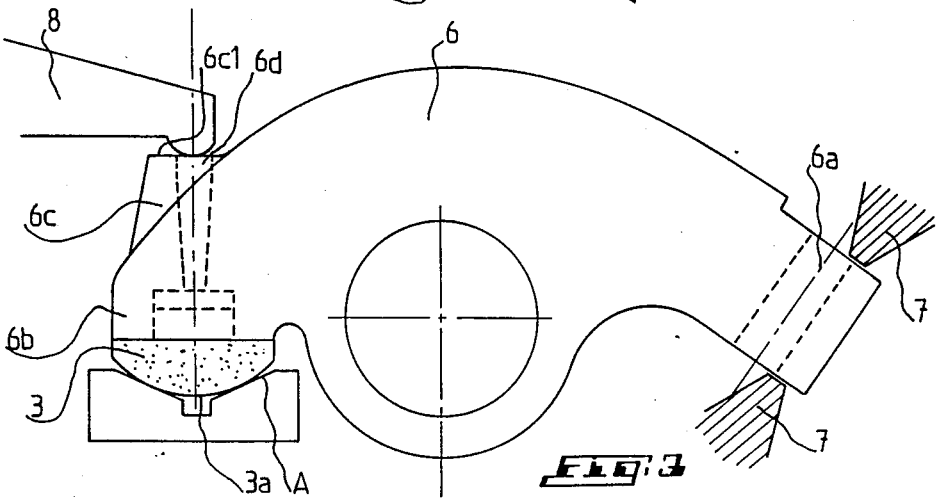
FIG. 3 diagrammatically shows the positioning of the rocker arm for the machining thereof.

FIG. 3 shows the rocker arm 6 obtained after moulding. The body of the rocker arm comprises the arm 6a co-operating with a valve spindle and the arm 6*b* co-operating with the cam of a camshaft and provided at its lower end with the ceramic reinforcing element 3. The numeral 6*c* designates the integral moulded projecting part obtained from the walls 1*a* and 1*b* of the bottom box 2. This projecting part comprises principally a plane surface 6*c*1 located opposite the reinforcing element 3 perpendicularly to the longitudinal axis of the latter. The spindle-forming part was extracted during the moulding with usual extracting means not shown. A hole remains which is delimited by the dotted lines and which terminates through an upper opening 6*d* at the surface 6*c*1, which opening was defined during the moulding by the lowest part of the elongated pusher 4*a*.

The advantage of the plane surface 6*c*1 is that it helps maintaining the position of the rocker arm 6 during the machining thereof.

This positioning is obtained by placing first the friction surface 3*a* of the reinforcing element 3 on a corresponding V-shaped, as shown in FIG. 3, or concave bearing surface A and by maintaining the end of the arm 6*a* of the rocker arm between two opposite holding jaws 7. A clamping finger-forming part 8 rests on the surface 6*c*1 and exerts a pressure on the latter with the aid of appropriate means (not shown) to firmly urge the reinforcing element 3 against the bearing surface A, to thus perform the final machining of the rocker arm 6. Of course, other modifications may be brought without departing from the scope of the present invention.

Thus, instead of being plane, the surface 6*c*1 may for example be slightly curved, the plane tangential to the surface 6*c*1 at the intersecting point thereof with the longitudinal axis of the spindle being perpendicular to the said axis.

Moreover, the pusher-forming device 4 may be formed also for example of a hydraulic or pneumatic device with a piston resting on the spindle 5.

What is claimed is:

1. A method for casting a rocker arm made of a light metal alloy for an internal combustion engine, said rocker arm including a lever body an arm of which, intended to co-operate with a cam of an engine camshaft, has a ceramic reinforcing element having an external convex friction surface intended to contact said cam; comprising the steps of polishing the friction surface of the ceramic reinforcing element;

mounting the thus-polished ceramic reinforcing element into a mold so that the polished friction surface rests in a recess of the mold having a shape complementary to that of the friction surface; and maintaining firmly the ceramic reinforcing element in the mold recess at least during an operation of molding the rocker arm with spindle-forming means located in a molding hollow space of said mold and elastically forcibly urged against an end of the reinforcing element opposite to the friction surface thereof.

2. The method of claim wherein said rocker arm includes opposite the reinforcing element and having a plane surface perpendicular to a longitudinal axis of the reinforcing element.

3. A mold structure having two half-molds, one top half-mold and one bottom half-mold for casting a rocker arm made of a light metal alloy for an internal combustion engine, said rocker arm including a lever body an arm of which, intended to co-operate with a cam of an engine camshaft, has a ceramic reinforcing element having an external convex friction surface intend to contact said cam; comprising a recess provided in the bottom half-mold, having a shape complementary to a previously polished convex friction surface of the reinforcing element which is disposed and rests therein; and a device for firmly and resiliently maintaining the reinforcing element in said recess during the operation of casting the rocker arm;

said maintaining device including spindle-forming means located in a molding hollow space in said mold and disposed on an end of the reinforcing element opposite to the friction surface thereof and a pusher-forming assembly above the spindle-forming means to forcibly and resililently urge the latter against the end of the reinforcing element.

4. The structure of claim 3, wherein the pusher-forming assembly includes an elongated pusher along an extension of the spindle-forming means, prestressed return resililent means urged against the elongated pusher, and means for prestressing the resilient means.

5. The structure of claim 4, wherein the resilient means is formed of a compression spring or resilient steel washers.

6. The structure of claim 3, wherein the pusher-forming assembly is housed inside the bottom half-mold.

7. The structure of claim 3, wherein the pusher-forming assembly is formed of a hydraulic or pneumatic device with a piston resting on the spindle-forming means.

8. A mold structure including two half-molds, one top half mold and one bottom half mold for casting a rocker arm made of a light metal alloy for an internal combustion engine, said rocker arm including a lever body an arm of which, intended to co-operate with a cam of a camshaft, has a ceramic reinforcing element having an external convex friction surface intended to contact said cam; comprising a recess provided in the bottom half-mold having a shape complementary to a previously polished friction surface of the reinforcing element which is disposed and rests in said recess; and a device for firmly and resiliently maintaining the reinforcing element in said recess during an operation of casting the rocker arm;

said maintaining device including spindle-forming means located in a molding hollow space in said mold and disposed on an end of the reinforcing element opposite to the friction surface thereof and a pusher-forming assembly above the spindle-forming means to forcibly urge the latter against the end of the reinforcing element, the pusher-forming assembly including an elongated pusher along an extension of the spindle-forming means, prestressed return resilient means urged against the elongated pusher, and means for prestressing the resilient means.

* * * * *